US005873149A

United States Patent [19]

Bonenberger

[11] Patent Number: 5,873,149

[45] Date of Patent: Feb. 23, 1999

[54] HOOD TILT HINGE

[76] Inventor: Clay Bonenberger, 106 Lambrecht, Beemer, Nebr. 68716

[21] Appl. No.: 838,511

[22] Filed: Apr. 8, 1997

[51] Int. Cl.[6] ..... E05D 3/06

[52] U.S. Cl. ..... 16/366; 16/371; 403/113

[58] Field of Search ..... 16/366, 371, 387, 16/386, 389, 392, 261, 263, 270; 403/112, 113, 117, 119; 180/69.21

[56] References Cited

U.S. PATENT DOCUMENTS

| | | | |
|---|---|---|---|
| 2,685,700 | 8/1954 | Summers | 16/366 |
| 4,532,674 | 8/1985 | Tobey et al. | 16/387 |
| 4,658,470 | 4/1987 | Oen | 180/69.21 |
| 5,611,114 | 3/1997 | Wood, Jr. et al. | 16/366 |
| 5,685,046 | 11/1997 | Neag et al. | 16/366 |

*Primary Examiner*—Chuck Mah

*Attorney, Agent, or Firm*—Adams H. Jacobs

[57] ABSTRACT

A hinge assembly includes an upper hinge section having a circumferential wall structure and a top plate and a lower hinge section having a circumferential wall structure and a bottom plate, the upper and lower hinge sections fitting together to form a single cylindrical hinge structure. A hinge bracket includes a generally flat plate and upper and lower bracket cylinders mounted thereto, the hinge bracket operative to pivotably connect the upper and lower hinge sections. The upper and lower bracket cylinders are arranged on the plate such that when the lower bracket cylinder is pivoted about a lower hinge pin mounted in the lower hinge section, rotational movement of the hinge bracket is restricted by contact of the hinge plate with a forward edge of the lower hinge section. The hinge assembly may be mounted on the frame of the vehicle and to the tilt-forward hood of the vehicle to permit freer access to the engine compartment of the vehicle than that previously available in the prior art.

7 Claims, 4 Drawing Sheets

HOOD TILT HINGE

BACKGROUND OF THE INVENTION

1. Technical Field

This invention relates to hinge mechanisms and, more particularly, to a hood tilt hinge operative to permit the forward tilting of the hood or front end upwards and outwards from the vehicle's main body, the hinge assembly including upper and lower generally cylindrical hinge sections and an offset hinge bracket pivotably connecting the two hinge sections such that the upper hinge section may be tilted forwardly relative to the lower hinge section with the hinge bracket providing stop means for preventing rotation of the upper hinge section.

2. Description of the Prior Art

On oversized or "monster" trucks, the engine of the truck as in standard trucks is covered by a hood and surrounded by front quarter panels. While access to the engine compartment may be gained through operation of a standard hood opening arrangement, however, due to the height of the "monster" trucks, it is preferred that the vehicle include a tilt-forward hood which raises the hood and front quarter panels to allow access to the engine compartment. Most trucks which include tilt-forward hoods support these hoods either by concealed hinges or exposed hinges. Exposed hinges include arrangements such as piano-type hinges mounted on the bumper structure to allow the front of the body to tilt forward. Concealed hinges are hidden within the hood and cannot be seen from the outside of the vehicle when the hood is closed. With each type of hinge, however, the main purpose is to allow access to the engine compartment.

Examples of exposed hinges are found throughout the prior art and include such devices as found in Miller, et al., U.S. Pat. No. 4,281,733, and Lundelius, U.S. Pat. No. 1,598,868. These devices are similar to one another and include the basic features of the exposed hinge, namely that the hinge is positioned generally adjacent the front bumper with the lower part of the hinge mounted to the main truck frame and the upper part of the hinge mounted to the hood itself. The hinge body itself is exposed just above the front bumper of the truck. Miller and Lundelius each also include tilt restraint devices which, in the case of both devices, is an hydraulic cylinder.

There are several disadvantages in the use of exposed hinges. These include the problem that exposed hinges will receive more wear and tear due to exposure to the environment and thus may become corroded or have their efficiency impaired due to grime or debris entering the hinge thus rendering it difficult to tilt the hood as designed. Also, the external appearance of the exposed hinge may be unsightly, unless steps are taken to design the vehicle's exterior styling so that the hinge blends in with it. Of course, depending on the size and shape of the hinge, this may not always be possible. Furthermore, none of the exposed hinges found in the prior art include built-in damping or stopping mechanisms to prevent overrotation of the hood. Therefore, additional stopping mechanisms are needed to prevent overrotation, increasing the complexity of the hinge arrangement and thus adding more elements which can fail to prevent the hinge from operating as designed. There is therefore a need for a hinge which will address and solve those problems found in the art of exposed hinges.

Another type of hinge commonly used for the tilting of hoods is the concealed hinge, examples of which are found in the prior art in such devices as shown in Peterson, U.S. Pat. No. 2,254,088 and Oen, U.S. Pat. No. 4,658,470. While both these devices disclose concealed hinges, it is Oen which is specifically directed to a truck having a tilt-forward hood. Generally, concealed hinges are mounted on a vehicle with the lower part of the hinge mounted to the frame of the vehicle and the upper part of the hinge mounted to the hood itself, the hinge being positioned generally adjacent the front bumper of the vehicle. However, unlike the exposed hinges, the concealed hinge is positioned inside the hood itself and thus is not visible when the hood is in the closed position. One of the disadvantages of the devices found in the prior art is that they tend to include additional moving parts and adjustment mechanisms beyond those which are strictly needed for operation of the concealed hinge. For example, Peterson includes a spring-loaded offset mechanism to allow the hood to move upwardly and forwardly such that rotation of the hood about the hinge is permitted. Oen, on the other hand, does not include an offset mechanism but does include an adjustment mechanism consisting of a threaded bolt for adjusting the position of the hinge. Obviously, with the addition of adjustment and offset devices to the hinge, additional potential problems are introduced, including malfunction of the adjustment device of Oen and the potential of the offset mechanism of Peterson to become stuck thus preventing the hood from being lifted. Furthermore, the construction characteristics found in the prior art may not be suitable for heavy duty vehicles which include heavy-hooded units or the like. Since oversized or "monster" trucks are often used in extremely muddy conditions, a sturdy and mechanically simple hinge assembly is preferable to those somewhat complex devices found in the prior art. There is therefore a need for a mechanically simple concealed hinge for use in oversized or "monster" trucks.

As stated previously, many of the hinges found in the prior art require a simple stop mechanism to prevent overrotation of the hood. It should be noted that the additional stop mechanisms shown in the prior art will tend to interfere with access to the engine compartment, thus reducing accessability to the engine department. There is therefore a need for a concealed hood tilt hinge which includes a stop mechanism built into the hinge itself.

Therefore, an object of the present invention is to provide an improved hood tilt hinge assembly.

Another object of the present invention is to provide a hood tilt hinge assembly which includes upper and lower hinge sections connected to one another by a hinge bracket, the hinge bracket including offset upper and lower bracket cylinders which are pivotably connected to the upper and lower hinge sections to allow the upper hinge section to tilt forwardly relative to the lower hinge section.

Another object of the present invention is to provide a hood tilt hinge assembly in which the hinge bracket includes a plate which, when pivoted a predetermined distance, will contact a section of the lower hinge section wall structure thus preventing further movement of the upper hinge section and acting as a stop mechanism.

Another object of the present invention is to provide a hood tilt hinge assembly which is concealed by the hood itself when the hood is in the closed position so that the hinge does not degrade the appearance of the vehicle on which it is placed.

Another object of the present invention is to provide a hood tilt hinge assembly which does not include superfluous adjustment or offset mechanisms which may render the hinge more vulnerable to breakdowns.

Another object of the present invention is to provide a hinge assembly which may be used as an artificial joint replacement hinge or the like.

Finally, an object of the present invention is to provide a hood tilt hinge assembly which is relatively simple to manufacture and which is safe and durable in use.

SUMMARY OF THE INVENTION

The present invention provides a hinge assembly which includes an upper hinge section having a circumferential wall structure and a top plate, the wall structure connected to and depending downwards from the top plate generally perpendicular thereto such that the upper section has a generally hollow interior. The hinge assembly also includes a lower hinge section having a circumferential wall structure and a bottom plate designed much the same as the upper hinge section. A hinge bracket includes a generally flat plate having upper and lower ends and upper and lower bracket cylinders mounted thereon. As provided, the upper and lower bracket cylinders each have a longitudinal center axis and outer walls, the upper bracket cylinder mounted on the plate adjacent the upper end of the plate, the lower bracket cylinder mounted on the plate adjacent the lower end of the plate. The upper bracket cylinder is mounted on the plate such that the longitudinal center axis of the upper bracket cylinder is generally parallel with the plate, with the cylinder disposed such that the plane of the plate intersects at least part of the upper bracket cylinder. The lower bracket cylinder of the hinge bracket is mounted on the plate such that the longitudinal center axis of the lower bracket cylinder is generally parallel with the center longitudinal axis of the upper bracket cylinder, the lower bracket cylinder disposed such that the plane of the plate does not intersect the lower bracket cylinder, meaning that the lower bracket cylinder is positioned either above or below the plate.

The lower bracket cylinder of the hinge bracket is pivotably connected to the lower hinge section such that the lower bracket cylinder is at least partially within the interior of the lower hinge section and the center longitudinal axis of the lower hinge bracket cylinder is generally parallel with the bottom plate of the lower hinge section. Likewise, the upper bracket cylinder of the hinge bracket is pivotably connected to the upper hinge section such that the upper bracket cylinder is at least partially within the interior of the upper hinge section and the longitudinal center axis is generally parallel with the top plate of the upper hinge section. In this manner, the upper hinge section may be pivoted forwards from the lower hinge section with the upper and lower bracket cylinders being rotated, the upper hinge section being prevented from overrotation by the hinge bracket plate contacting the wall structure of the lower hinge section. The connection of the lower and upper bracket cylinders to the lower and upper hinge sections respectively is best accomplished by the insertion of the hinge pins through the upper and lower bracket cylinders, the hinge pins extending into the wall structures of the upper and lower hinge sections to secure the hinge bracket between the upper and lower hinge sections.

The hinge assembly as thus described clearly offers several advantages over those devices found in the prior art. The relatively simple design of the hinge is designed to reduce the potential for breakdowns of the hinge. Also, because the hinge includes two axes of rotation, the hood to which the unit is attached may be rotated a greater amount to ease access to the engine compartment of the vehicle. Furthermore, because the hinge bracket plate is designed to contact the wall of the lower hinge section to prevent overrotation of the upper hinge section, there is no need for additional stop mechanisms to be added to the hinge of the present invention. The present invention thus provides a substantial improvement over those devices found in the prior art.

DESCRIPTION OF THE PREFERRED EMBODIMENT

Figure 1:
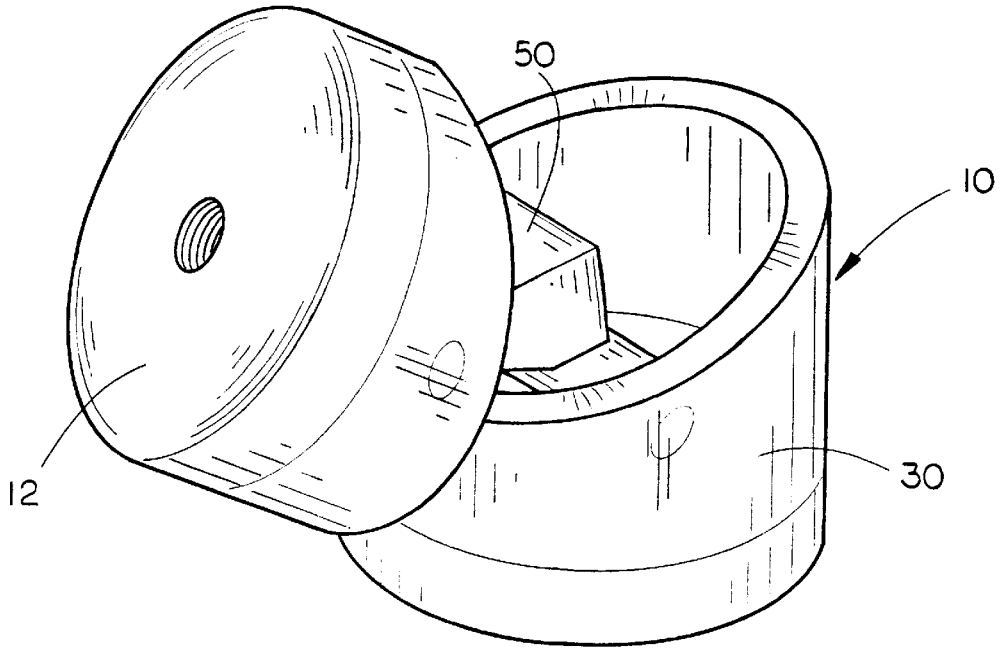
FIG. 1 is a perspective view of the hinge of the present invention in the open position showing the hinge bracket extending between the upper and lower hinge sections.
Figure 4:
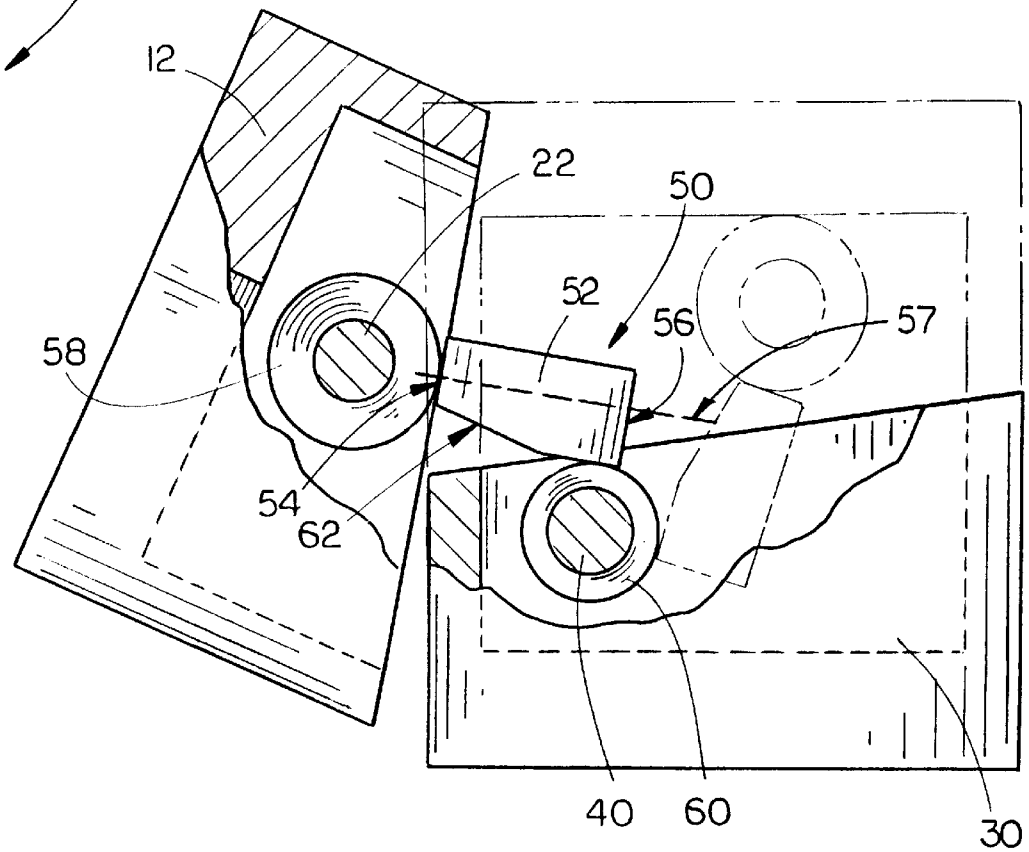
FIG. 4 is a partial side elevational view of the hinge showing the internal mechanism of the hinge.

The hood tilt hinge 10 of the present invention is best shown in FIGS. 1–6 as including an upper hinge section 12, lower hinge section 30 and hinge bracket 50 extending between and pivotably connecting upper hinge section 12 and lower hinge section 30. Upper hinge section 12 preferably includes a circumferential wall structure 14 and top plate 16, the wall structure 14 connected to depending downwards from the top plate 16 as shown in FIGS. 1 and 4. Wall structure 14 preferably is generally cylindrical in shape and would preferably have an external diameter of between two and five inches and a wall thickness between one-eighth inch and one-half inch. Of course, the dimensions stated above and any other dimensions given in this description should be understood to be non-critical to the invention, provided the functional characteristics of the invention are maintained.

It is preferred that top plate 16 be a generally circular plate having a diameter generally equal to the outer diameter of the wall structure 14 and a thickness between one-eighth inch and one-half inch such that the top plate 16 will act to "cap" the wall structure 14. Top plate 16 is preferably connected to wall structure 14 by welding or the like, although the exact method of the connection is not crucial to the present invention. Furthermore, unless otherwise stated, it is preferred that all fixed metal connections described herein be welded connections or the like.

Lower hinge section 30 includes similar elements as those described in upper hinge section 12, specifically with lower hinge section 30 including a circumferential wall structure 32 and bottom plate 34, the wall structure 32 connect to and extending upwards from the bottom plate 34. It is further preferred that wall structure 32 and bottom plate 34 each have similar dimensions as those described in connection with wall structure 14 and top plate 16 of upper hinge section 12. In fact, wall structure 14 and wall structure 32 are preferably formed as two sections of a single cylinder with a dividing cut being made in the cylinder to form the wall structure 14 of upper hinge section 12 and the wall structure 32 of the lower hinge section 30. Therefore, wall structure 14 and wall structure 32 would have substantially identical outer diameters and wall thicknesses.

Figure 3:
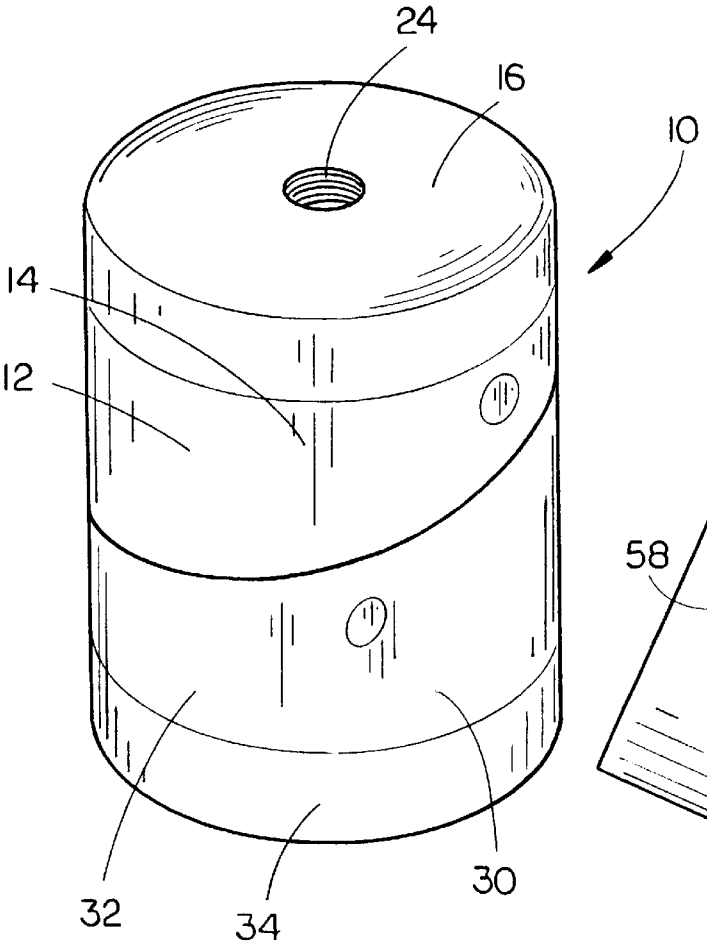
FIG. 3 is a perspective view of the hinge in the closed position.

The lower edge 18 of wall structure 14 of upper hinge section 12 is preferably angled to slope downwards from the rear 70 of hood tilt hinge 10 to the front 72 of hood tilt hinge 10, as best shown in FIG. 4. It is preferred that this angle be between 10 degrees and 40 degrees from horizontal. Similarly, the upper edge 36 of wall structure 32 of lower hinge section 30 would have a substantially identical angle formed thereon such that upper hinge section 12 and lower hinge section 30 will fit together as shown in FIG. 3.

Figure 5:
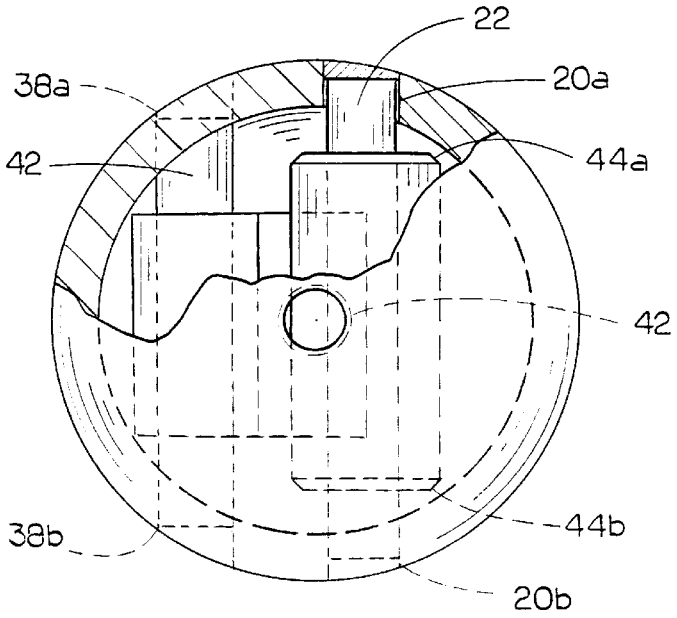
FIG. 5 is a detail top plan view of the hinge showing the internal connections of the hinge.
Figure 6:
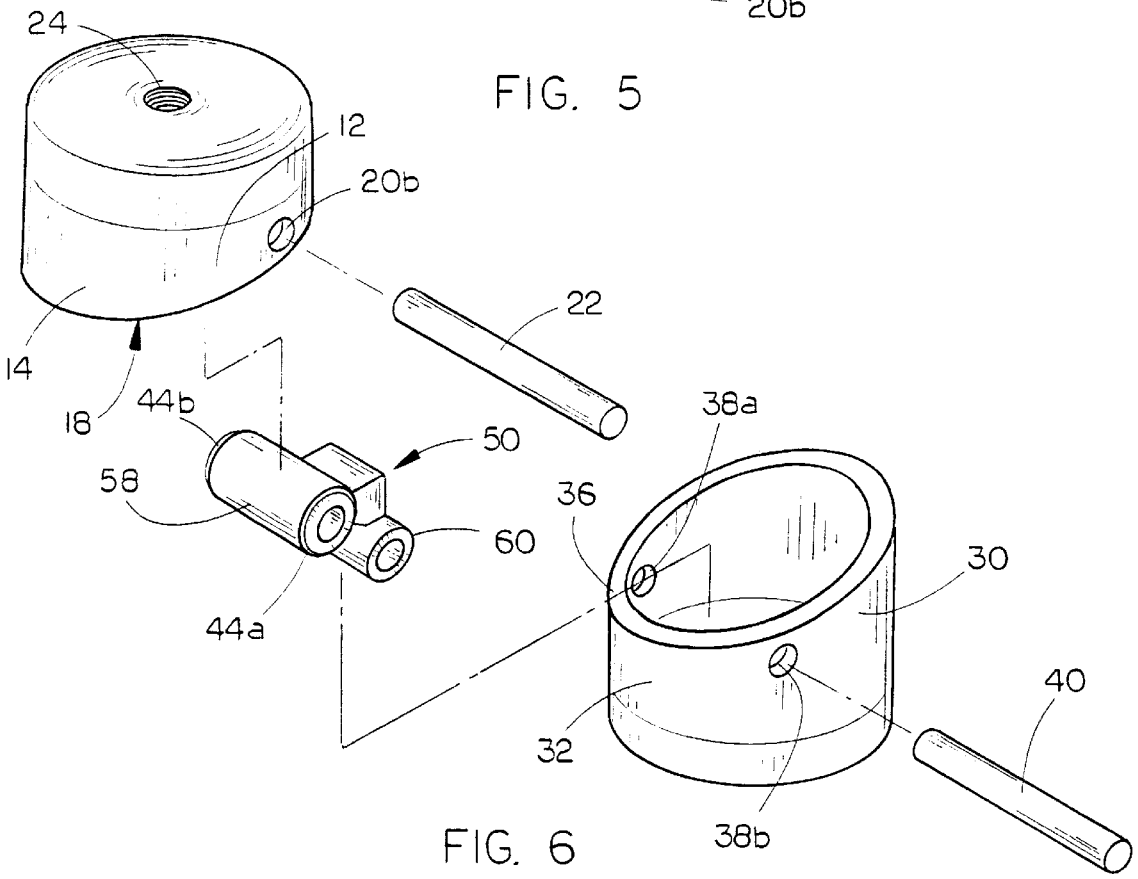
FIG. 6 is an exploded view of the hinge of the present invention showing the elements thereof.

As shown best in FIGS. 4–6, the wall structure 14 of upper hinge section 12 would preferably include a pair of hinge pin securement holes 20*a* and 20*b* formed extending through wall structure 14 and positioned on opposite sides of upper hinge section 12. In the preferred embodiment, hinge pin securement holes 20*a* and 20*b* would be formed in wall structure 14 such that the holes 20*a* and 20*b* are spaced equally downwards from top plate 16, are positioned towards the rear 70 of hood tilt hinge 10 and are generally concentrically aligned such that a hinge pin may be slid therethrough.

Likewise, formed in wall structure 32 of lower hinge section 30 are a pair of lower hinge pin securement holes 38*a* and 38*b*. Lower hinge pair securement holes 38*a* and 38*b* are preferably formed such that both holes are spaced equally upwards from bottom plate 34, are positioned towards the front 72 of hood tilt hinge 10 and are in generally concentrical alignment such that a hinge pin may be slid therethrough. In the preferred embodiment, hinge pin securement holes 20*a*, 20*b*, 38*a* and 38*b* would each have a diameter of one-quarter to one-half inch.

The hinge bracket 50 for connecting upper hinge section 12 and lower hinge section 30 is best shown in FIGS. 4 and 6 as including a generally flat hinge plate 52 having an upper end 54 and a lower end 56 and a plate plane 57 which extends through the hinge plate 52 as shown in FIG. 4, and upper and lower bracket cylinders 58 and 60. The upper bracket cylinder 58 is preferably mounted to the hinge plate 52 adjacent upper end 54 of hinge plate 52 and lower bracket cylinder 60 is preferably mounted to hinge plate 52 adjacent lower end 56 of hinge plate 52. As shown best in FIGS. 4–6, the upper bracket cylinder 58 is preferably mounted on hinge plate 52 such that the center longitudinal axis of the upper bracket cylinder 58 is generally parallel with the hinge plate plane 57 and the upper bracket cylinder 58 is mounted on the upper end 54 of hinge plate 52. As shown in FIG. 4 upper bracket cylinder 58 may be slightly offset from the plane 57 of hinge plate 52, but it is expected that the plane 57 of hinge plate 52 will intersect at least part of the upper bracket cylinder 58 so that upper bracket cylinder 58 will always be mounted on upper end 54 of hinge plate 52.

On the other hand, lower bracket cylinder 60 is preferably mounted on hinge plate 52 such that lower bracket cylinder 60 is offset from the plane 57 of hinge plate 52 and, in fact, is preferably mounted to the side face 62 of hinge plate 52 adjacent lower end 56 as shown best in FIG. 4. Lower bracket cylinder 60 is preferably aligned generally parallel with upper bracket cylinder 58.

In the preferred embodiment, hinge plate 52, upper bracket cylinder 58 and lower bracket cylinder 60 would all be constructed of high tensile strength steel and it is further preferred that the internal diameters of cylinders 58 and 60 be approximately equal to the diameters of hinge pin securement holes 20*a*, 20*b*, 38*a*, and 38*b* in upper and lower hinge sections 12 and 30. In the embodiment shown in FIGS. 1–6, upper bracket cylinder 58 has a thicker wall structure than lower bracket cylinder 60 and upper bracket cylinder 58 is longer than lower bracket cylinder 60. The chief reason for this design difference is the positioning of the lower hinge pin securement holes 38*a* and 38*b* which require lower bracket cylinder 60 to be of a shorter length and to have a smaller diameter in order to fit within the lower hinge section 30. For definitional purposes only, it is preferred that upper bracket cylinder 58 have a length between one-half and three inches, lower bracket cylinder 60 have a length between one inch and two inches, and hinge plate 52 have a length between one-half and one inch, a width between one inch and three inches and a thickness between one-eighth inch and five-eights inches. Of course, these dimensions are not critical to the present invention so long as the operation of the invention is not impaired.

For securing hinge bracket 50 to upper hinge section 12 and lower hinge section 30, an upper hinge pin 22 and lower hinge pin 40 are provided. Upper and lower hinge pins 22 and 40 are preferably cylindrical rods having diameters slightly less than the diameters of hinge pin securement holes 20*a*, 20*b*, 38*a* and 38*b* such that hinge pins 22 and 40 may be slid therethrough. FIG. 6 is an exploded view of the hood tilt hinge 10 of the present invention showing how each of the elements fit together within the hinge 10. Specifically, upper bracket cylinder 58 of hinge bracket 50 is aligned generally concentrically with hinge pin securement holes 20*a* and 20*b* and upper hinge pin 22 is slid therethrough thereby pivotably securing upper bracket cylinder 58 to upper hinge section 10. Similarly, lower bracket 60 is aligned generally concentrically with lower hinge pin securement holes 38*a* and 38*b* and lower hinge pin 40 is slid therethrough thereby pivotably securing lower bracket cylinder 60 to lower hinge section 30. For both upper and lower hinge pins 22 and 40, it is preferred that the overall length of each of the hinge pins 22 and 40 be slightly less than the chord distance between the outer edges of the hinge pin securement holes 20*a*, 20*b*, 38*a* and 38*b* in which the hinge pins 22 and 40 are placed. In other words, when hinge pins 22 and 40 are placed within upper and lower hinge sections 12 and 30, the ends of the hinge pins 22 and 40 will be within the outer walls of the hinge sections 12 and 30 but will extend past the inner walls of the wall structures 14 and 32 of the upper and lower hinge sections 12 and 30.

Once the hinge bracket 50 is pivotally secured to upper and lower hinge sections 12 and 30 by upper and lower hinge pins 22 and 40, the hinge pins 22 and 40 may be secured in place. It is preferred that the securement be done by plug welds which will permanently fix the hinge pins 22 and 40 within the hinge pin securement holes 20*a*, 20*b*, 38*a* and 38*b*. Of course, any other type of securement means may be used to secure the hinge pins 22 and 40 within upper and lower hinge sections 12 and 30, but it is preferred that plug welds be used to provide a sturdy and secure mounting for the hinge pins 22 and 40.

FIGS. 5 and 6 each show an alternative design for the upper bracket cylinder 58, one which would include chamfered ends 44*a* and 44*b* on each end of the upper bracket cylinder 58 so that the outer walls of the cylinder 58 are beveled as shown. The main reason for having the chamfered ends 44*a* and 44*b* is to permit the cylinder 58 to be slightly wider and still avoid contact with the wall structure 14. The strength of the upper bracket cylinder 58 is thus increased due to the additional metal used for construction thereof. Of course, lower bracket cylinder 60 may also include chamfered ends, but it is to be understood that the chamfered ends 44*a* and 44*b* as thus described are not critical to the invention.

Figure 2:
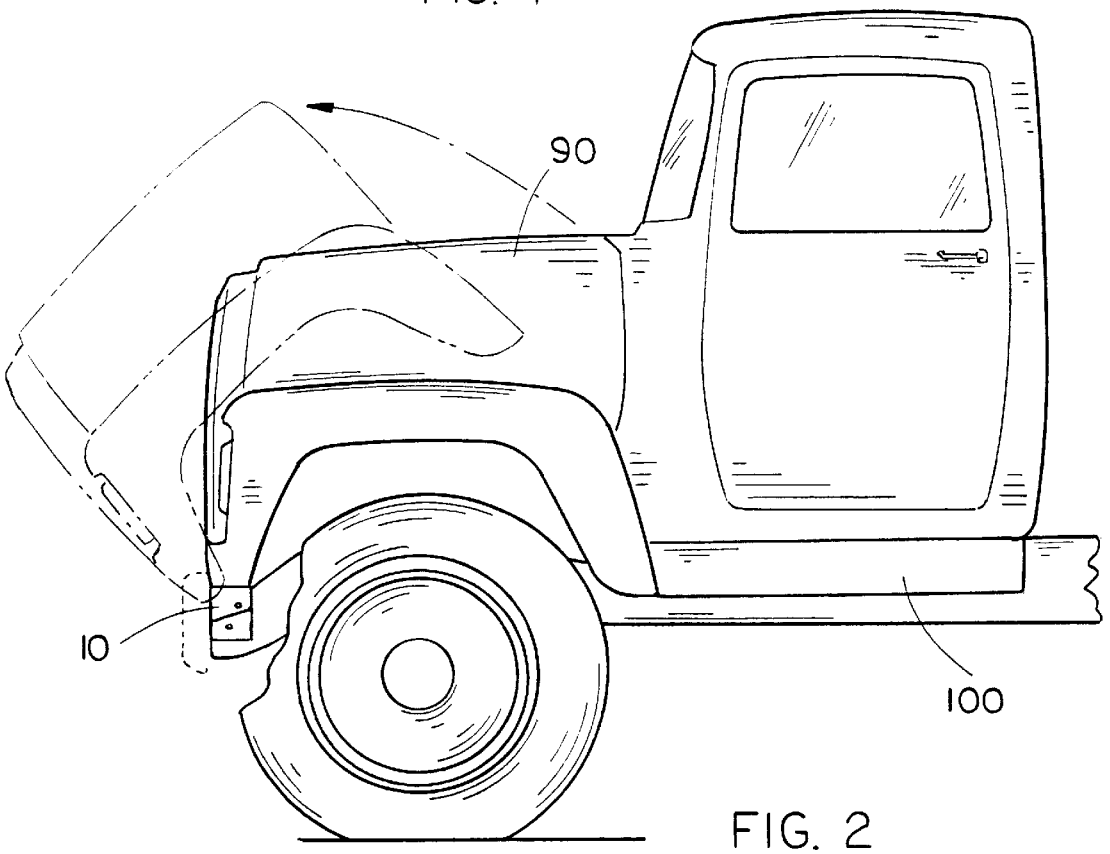
FIG. 2 is a perspective view of the hinge in place on the front of a vehicle.

Once the hood tilt hinge 10 is assembled, the reasons and purposes for the arrangements of elements are exhibited. The purpose for which the hood tilt hinge 10 was designed was to allow a front hood unit to be tilted forwards to allow access to the engine compartment of the vehicle. As shown in FIG. 2, the hood 90 of the vehicle 100 is being forwardly tilted to allow access to the engine compartment of the vehicle 100. When the hood tilt hinge 10 of the present invention is being used in such a manner, it is preferred that two hood tilt hinges be used, one mounted adjacent each side of the vehicle 100 so that the hood 90 may be safely and securely supported by the two hood tilt hinges.

When the hood tilt hinge 10 is opened, lower bracket cylinder 60 pivots about lower hinge pin 40 thus allowing upper hinge section 12 to move upwards and forwards relative to lower hinge section 30. As rotation of lower bracket cylinder 60 about lower hinge pin 40 continues, the upper hinge section 12 continues to move forward, until hinge plate 52 comes into contact with the upper edge 36 of wall structure 32 of lower hinge section 30 as shown best in FIG. 4. Once hinge plate 52 contacts the upper edge 36 of wall structure 32, rotation of lower bracket cylinder 60 about lower hinge 40 is prevented. However, continued rotation of upper bracket cylinder 58 about hinge pin 22 is permitted and therefore, the hood 90 may continue to be swung out of the way of the engine compartment, thus allowing freer access to the engine compartment than would ordinarily be permitted by a single pivot assembly.

The amount of rotation of lower bracket cylinder 60 about lower hinge pin 40 is controlled by two factors. First is the amount of bevel formed in side face 62 of hinge plate 52. It is preferred that side face 62 of hinge plate 52 extend at the angle shown in FIG. 4 such that a sufficient connection point for upper bracket cylinder 58 is still provided yet free rotation of lower bracket cylinder 60 about lower hinge pin 40 is permitted. The second and most important controlling factor for the rotation of lower bracket cylinder 60 about lower hinge pin 40 is determined by the angle of upper edge 36 and specifically the height of the wall structure 32 adjacent the contact point of hinge plate 52 with upper edge 36 of wall structure 32. Clearly, the lower the height of wall structure 32 at that point, the more rotation which is allowed for lower bracket cylinder 60 about lower hinge pin 40. This height is controlled by the angle of lower and upper edges 18 and 36 of wall structures 14 and 32 and it is believed that varying this angle between ten degrees and forty degrees will provide sufficient variation in the amount of rotation allowed of lower bracket cylinder 60. Of course, it is not necessary that the forward side of wall structure 32 be angled, as it is understood that various cutouts of the wall section and/or other such variations may produce the same intended results. Therefore, the precise means by which the height of the wall structure 32 at the contact point of hinge plate 52 is modified is not critical to the invention so long as the functional characteristics of the invention are maintained.

Finally, for connecting the hood tilt hinge 10 to a vehicle 100 and a hood 90, upper and lower connection holes 24 and 42 are provided, upper connection hole 24 formed in top plate 16 and lower connection hole 42 formed in bottom plate 34. Of course, top plate 16 and bottom plate 34 may include any type of connection means, including multiple holes or protruding bolts, so long as the hood tilt hinge 10 of the present invention may be connected to a vehicle 100.

Figure 7:
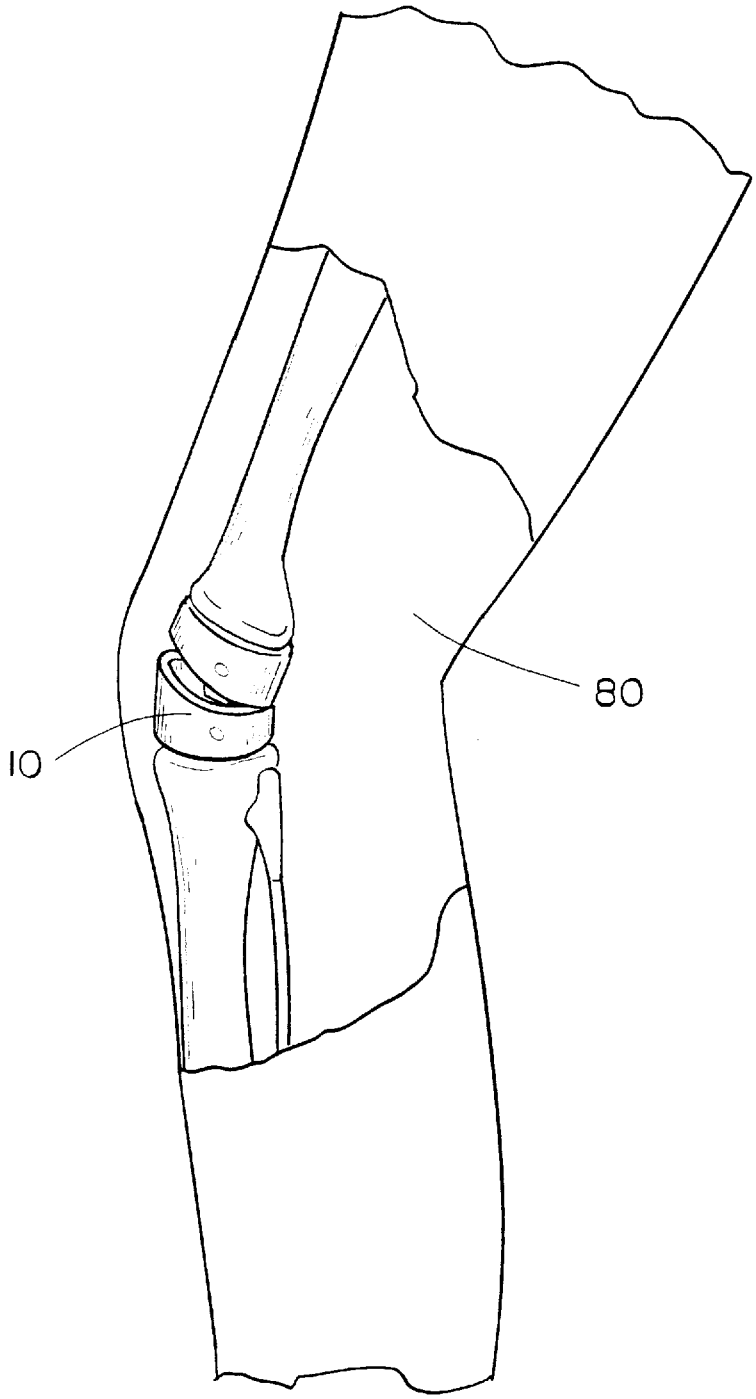
FIG. 7 is a side elevational detail view showing the hinge of the present invention being used as an artificial knee in a human leg.

FIG. 7 exhibits an alternative use of the hinge 10 of the present invention. Specifically, the hinge 10 is shown being used to replace the knee of a person's leg 80. It is believed that the use of the hinge in such a manner will be understood by those skilled in the art of joint replacement, and therefore additional description of the precise installation and use of the hinge in the knee will not be discussed at this time.

It is to be understood that numerous additions, substitutions and modifications may be made to the hinge of the present invention which fall within the intended broad scope of the appended claims. For example, the overall dimensions of each of the elements of the invention may be changed or modified so long as the functional characteristics of the invention are maintained. Furthermore, the materials used in construction of the invention may be modified should use of graphite composite materials or the like be preferred to use of metal products. Finally, the precise locations and connections of elements of the invention described above and shown in the accompanying drawings may be modified within the scope of the claims should such modification prove desirable.

There has therefore been shown and described a hood tilt hinge which accomplishes at least all of the stated objectives.

I claim:

1. A hinge assembly comprising:

an upper hinge section having a circumferential wall structure and a top plate, said wall structure connected to and depending downwards from said top plate generally perpendicular thereto such that said upper section has a generally hollow interior;

a lower hinge section having a circumferential wall structure and a bottom plate, said wall structure connected to and extending upwards from said bottom plate generally perpendicular thereto such that said lower hinge section has a generally hollow interior;

a hinge bracket having a hinge body including upper and lower ends and a center longitudinal plate plane, and upper and lower bracket cylinders, said upper and lower bracket cylinders each having a longitudinal center axis and outer walls; said upper bracket cylinder mounted on said hinge body adjacent said upper end of said hinge body, said lower bracket cylinder mounted on said hinge body adjacent said lower end of said hinge body;

said upper bracket cylinder of said hinge bracket mounted on said hinge body such that said longitudinal center axis of said upper bracket cylinder is generally parallel with said hinge body, said upper bracket cylinder disposed such that said plane of said hinge body intersects at least part of said upper bracket cylinder;

said lower bracket cylinder of said hinge bracket mounted on said hinge body such that said longitudinal center axis of said lower bracket cylinder is generally parallel with said center longitudinal axis of said upper bracket cylinder, said lower bracket cylinder disposed such that said lower bracket cylinder is free of intersection of said plane of said hinge body;

said lower bracket cylinder of said hinge bracket pivotably connected to said lower hinge section such that said lower bracket cylinder is at least partially within said interior of said lower hinge section and said center longitudinal axis is generally parallel with said bottom plate of said lower hinge section;

said upper bracket cylinder of said hinge bracket pivotably connected to said upper hinge section such that said upper bracket cylinder is at least partially within said interior of said upper hinge section and said longitudinal center axis is generally parallel with said top plate of said upper hinge section; and said upper hinge section being pivoted forwards from said lower hinge section upon said upper and lower bracket cylinders being rotated, said upper hinge section prevented from overrotation by said hinge body contacting said wall structure of said lower hinge section.

2. The hinge assembly of claim 1 wherein said circumferential wall structures of said upper and lower hinge sections are generally cylindrical in shape each having generally identical inner and outer diameters.

3. The hinge assembly of claim 1 wherein said top plate of said upper hinge section and said bottom plate of said lower hinge section each further comprise upper and lower connection holes, said upper connection hole formed in said top plate and said lower connection hole formed in said bottom plate, said connection holes operative to permit connection of said hinge assembly to the frame and the hood of a vehicle.

4. The hinge assembly of claim 1 wherein said hinge body of said hinge bracket further includes a side face on which said lower bracket cylinder is mounted generally adjacent said lower end of said hinge body, said upper bracket cylinder mounted on said upper end of said hinge body.

5. The hinge assembly of claim 1 wherein said pivotable connections of said upper and lower bracket cylinders to said upper and lower hinge sections comprise an upper hinge pin and a lower hinge pin, respectively, said upper and lower hinge pins consisting of generally cylindrical rods extending through, respectively, said upper bracket cylinder and said lower bracket cylinder, the ends of said upper hinge pin being secured within said wall structure of said upper hinge section and the ends of said lower hinge pin being secured within said wall structure of said lower hinge section whereby said upper bracket cylinder is pivotable about said upper hinge pin and said lower bracket cylinder is pivotable about said lower hinge pin.

6. The hinge assembly of claim 1 wherein said hinge body comprises a generally flat hinge plate.

7. A hinge assembly comprising:

an upper hinge section having an outer wall structure and a top plate, said wall structure connected to and depending downwards from said top plate;

a lower hinge section having an outer wall structure and a bottom plate, said wall structure connected to and extending upwards from said bottom plate;

a hinge bracket having a generally flat plate including upper and lower ends and a side face and upper and lower bracket cylinders, said upper bracket cylinder mounted on said plate adjacent said upper end of said plate, said lower bracket cylinder mounted on said plate adjacent said lower end of said plate;

said lower bracket cylinder of said hinge bracket mounted on said plate offset from said upper bracket cylinder on said side face of said plate;

said lower bracket cylinder of said hinge bracket pivotably connected to said wall structure of said lower hinge section, said center longitudinal axis of said lower bracket cylinder generally parallel with said bottom plate of said lower hinge section;

said upper bracket cylinder of said hinge bracket pivotably connected to said wall structure of said upper hinge section, said longitudinal center axis of said upper bracket cylinder generally parallel with said top plate of said upper hinge section; and said upper hinge section being pivoted forwards from said lower hinge section upon rotation of said upper and lower bracket cylinders, said upper hinge section prevented from overrotation by said hinge bracket plate contacting said wall structure of said lower hinge section.

* * * * *